United States Patent [19]

Whitten, Jr. et al.

[11] Patent Number: 4,691,868

[45] Date of Patent: Sep. 8, 1987

[54] SCREEN SIZER

[75] Inventors: Gilbert Y. Whitten, Jr., Charlotte; Kenneth E. Joyner, Jr., Midland; Benjamin E. Boren, Charlotte, all of N.C.

[73] Assignee: Midrex International, B.V., Zurich, Switzerland

[21] Appl. No.: 830,437

[22] Filed: Feb. 18, 1986

[51] Int. Cl.[4] ..... B02L 73/08

[52] U.S. Cl. ..... 241/24; 241/154; 209/672

[58] Field of Search ..... 209/671, 672, 673; 241/14, 24, 27, 29, 152 R, 98, 154, 189 R, 236

[56] References Cited

U.S. PATENT DOCUMENTS 2,966,267 12/1960 Dunbar ..... 209/672 X

FOREIGN PATENT DOCUMENTS 2072049 9/1981 United Kingdom ..... 209/672

*Primary Examiner*—Timothy V. Eley

*Attorney, Agent, or Firm*—Ralph H. Dougherty

[57] ABSTRACT

A screening and sizing apparatus for handling clusters or clumps of particulate material in which a roller table is provided with a series of equally spaced anvils or lugs for moving clusters of particulates across the rolls of the roller table and for breaking large lumps or clusters of material by forcing them against adjacent rolls or lugs. An alternative embodiment includes a tramp door through which large particles are passed to a separate bin or receptacle. Another alternative embodiment includes a cooperating, eccentrically mounted cluster breaker above the roller table.

20 Claims, 9 Drawing Figures

SCREEN SIZER

BACKGROUND OF THE INVENTION

The present invention relates to a method and apparatus for grading, separating and breaking large clumps of agglomerated particulate material, and classifying the material according to size. This invention is particularly well suited for handling product from a direct reduction furnace in which particulates are subjected to high temperatures and often form clusters.

Devices of this type are known as roller screen conveyors or material classifiers. Such devices are shown in U.S. Pat. Nos. 2,966,267 and 4,405,050. However, none of the prior art devices have a positive breaking action which is developed by the present invention. U.S. Pat. No. 2,966,267 teaches a series of co-operating rolls aligned with parallel axes, each roll being provided with a plurality of equally spaced square cut grooves of uniform depth, the grooves being at an angle to the roll axis other than normal. U.S. Pat. No. 4,405,050 teaches a roller screen having a plurality of spaced rollers, without any grooving, but with the spacing so selected that only properly sized material will fall through the gaps between the rolls. It is clear that elongated material could readily fall through such spaces, resulting in unsatisfactory sizing of the processed material.

The apparatus comprises a series of screen rolls having radial projections, and a sizer roll having a series of offset discs that intermesh with the teeth of the screen rolls. The rolls reciprocate through a sufficient angle to move clusters onto the next roll or to break the clusters into smaller units which will fall through the recesses between the rolls and between the teeth. Preferably, the apparatus includes three or more rolls, each with similar projections. The sizer roll impacts clusters and oversize material, breaking it to acceptable size. The sizer roll shaft lifts out of its normal operative position to allow material remaining oversize to pass to a final screen roll, which directs the oversize material into a receptacle for further handling or crushing.

OBJECTS OF THE INVENTION

It is the principal object of this invention to provide a means for screening hot particulate materials subject to sticking or clustering during heat treatment.

It is another object of this invention to convey and separate clusters of agglomerated or hardened material.

It is also an object of this invention to break clusters to a predetermined size.

It is a further object of this invention to provide apparatus for separating sized and oversized material and discharging each into a separate receptacle for further handling.

SUMMARY OF THE INVENTION

The present invention is an apparatus for classifying and breaking clumps of agglomerated material having a plurality of rolls mounted on parallel axes, each roll being powered in conjunction with adjacent rolls and movable reciprocally, each roll being rotatable at the same speed as all other rolls and in the same direction simultaneously. Each roll is provided with a plurality of spaced material-carrier lugs, which extend about the circumference of the roll, about 80° to 120° of the circumference, each lug being laterally spaced from each adjacent lug the distance equal to its own width plus a predetermined clearance. The lugs may have a series of teeth, if desired. A bin is provided beneath the classifying apparatus to receive the classified material. A discharge chute or other mechanism is situated adjacent the last roll in the series for receiving oversized material which remains unbroken by action of the apparatus. A sizer roll can be mounted above the final two screen rolls in the series, the sizer roll having eccentrically mounted discs that rotate between the discs of the final rolls in the series.

BRIEF DESCRIPTION OF THE DRAWINGS

The invention is better understood by reference to the following detailed description and to the appended drawings in which.

DETAILED DESCRIPTION

Figure 1:
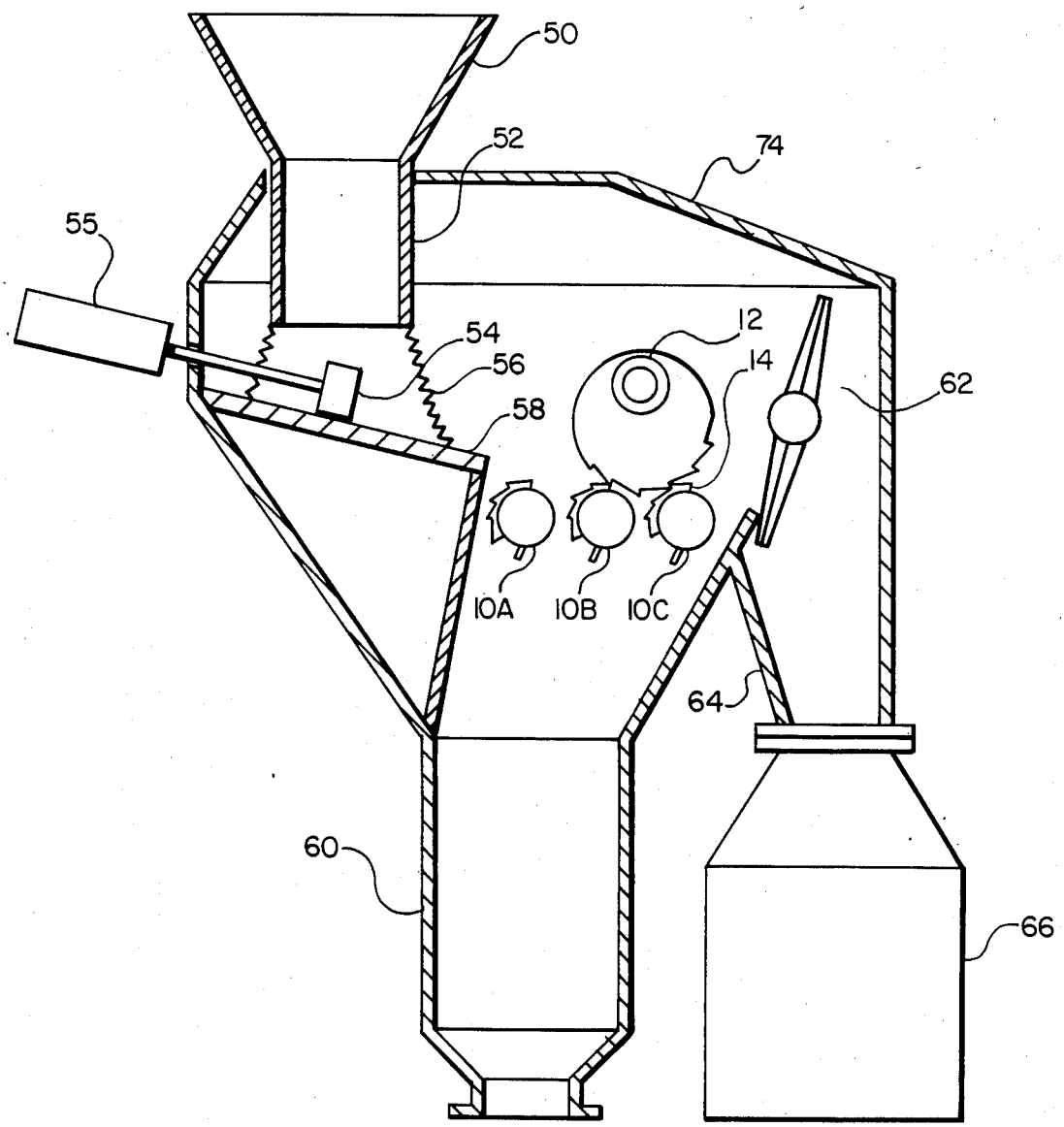
FIG. 1 is a schematic elevational view of a vertical cross-section of the product discharge chamber of a direct reduction furnace for the reduction of iron ore, showing the invented apparatus installed therein at the product discharge area adjacent the product pusher bar.

One of the best modes of operation of the invented apparatus is in conjunction with a discharge mechanism of a direct reduction furnace for the production of iron. Hot pellets and lumps of direct reduced iron (DRI) will often form clusters within the shaft furnace from the heat therein. These clusters must be broken for subsequent handling, and to provide a good quality feed material for steelmaking or foundry operations, or the like. Thus, the apparatus is shown and described in conjunction with the discharge mechanism and product discharge chamber of a direct reduction furnace, as best shown in FIG. 1.

Referring now to the drawings, the invented screen-sizer apparatus comprises at least three parallel screen rolls 10A, 10B, and 10C, having parallel and coplanar axes, which form a roller table unit, and one sizer roll 12 located between and above the final two screen rolls 10B and 10C. Each screen roll carries a plurality of laterally spaced anvils or lugs 14 mounted about a portion of its circumference. Each anvil is mounted in exactly the same quadrant of the roll, all screen rolls 10 are identical, and all screen rolls in one roller table are mounted in the same orientation. The anvils 14 are spaced equidistant along the roll body to form a plurality of openings through which particulates may fall. The screen roll spacing and anvil dimensions are determined by the desired product size. The screen rolls are so mounted that there is a small clearance between the anvils 14 of one roll 10 and the anvils of the adjacent roll, regardless of the movement of the rolls and associated anvils. The anvils preferably have saw-like teeth 16 facing toward the direction of material feed to the rolls.

Each roll 10 is mounted for rotation on a shaft 18, coupled to a reciprocating drive means (not shown) for moving the screen rolls through an arc of from 90° to about 120°. The leading edges of the anvils 14 at the starting position are substantially within the plane of the axes of the rolls, and they rotate around the axes of each respective roll upwardly through the specified arc, then return to the starting position. Opposite the leading edge of each anvil is a protruding lug 20 mounted on the roll 10, for removing material wedged or caught between adjacent anvils of the adjacent screen roll. Since it is preferable that all screen rolls be interchangable, all rolls are provided with lugs 20, which are advantageously cylindrically shaped.

Figure 3:
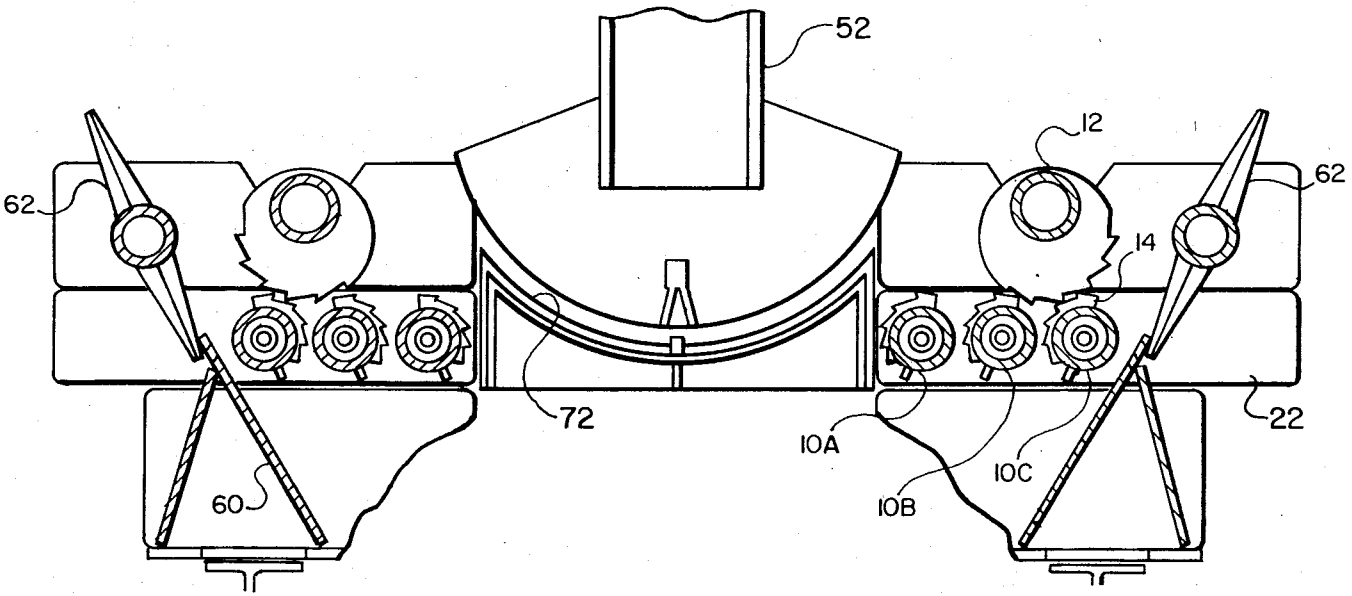
FIG. 3 is a partial sectional elevation of the wiper bar and invented screening and sizing apparatus on a larger scale than shown in FIG. 2.
Figure 4:
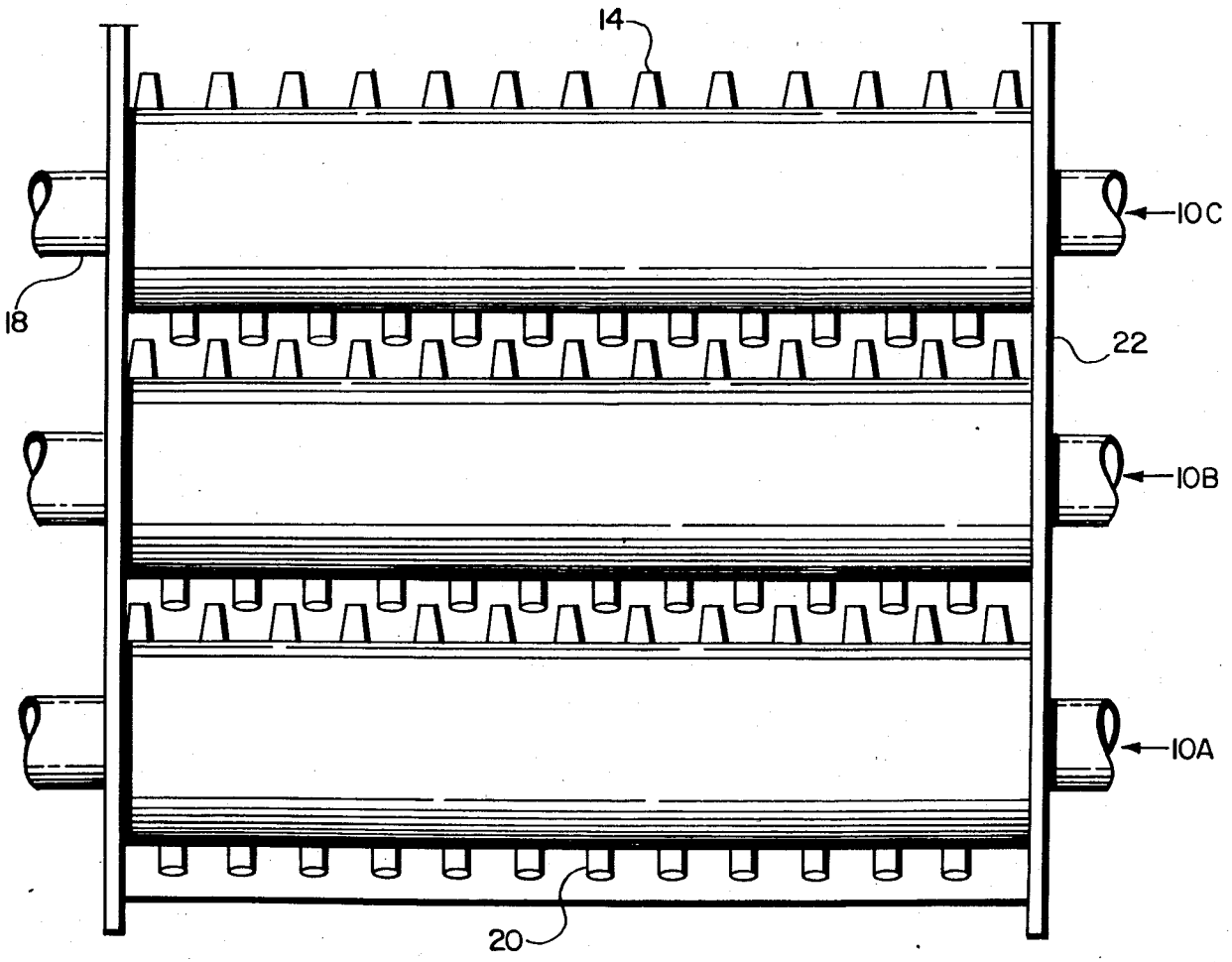
FIG. 4 is a plan view of a screen roll table showing the relationship of the lugs or anvils carried by each roll.

Side shields 22, shown in FIGS. 3 and 4, which are coextensive with the roller table, are provided at each end of the rolls 10 for retaining material to be classified within the operative portion of the rolls, and a receiving bin is provided beneath the rolls for receiving classified material.

Figure 7:
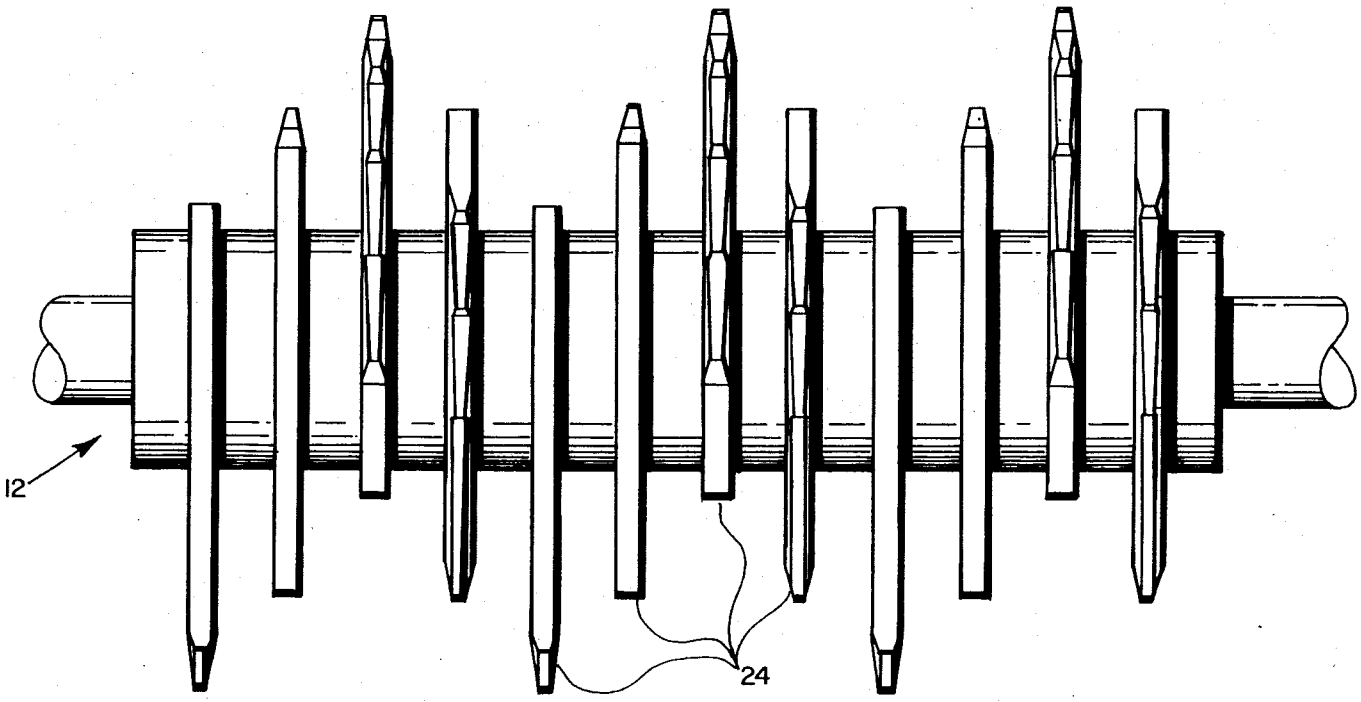
FIG. 7 is a plan view of a sizer roll showing the orientation of the sizing discs.
Figure 9:
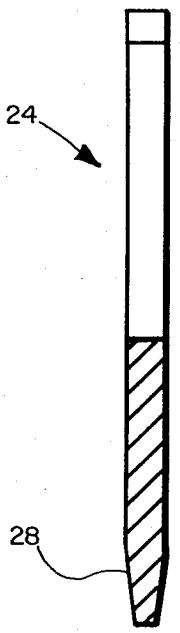
FIG. 9 is a cross sectional view of the disc of FIG. 7 taken along line 9—9 of FIG. 8.
Figure 8:
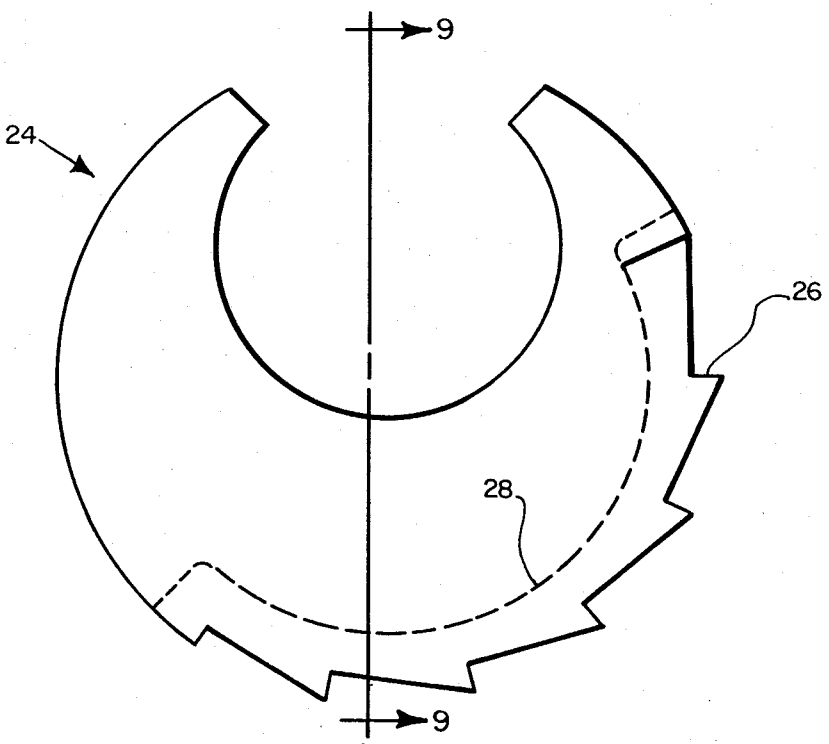
FIG. 8 is a side view of a single sizing disc.

The sizer 12, which carries eccentrically mounted, laterally spaced discs 24, is situated between and above the second and third screen rolls (10B and 10C of FIG. 1) with the axis of the sizer roll parallel to and approximately midway between the axes of the shafts of the screen rolls. The sizer discs 24 are equally spaced as shown in FIG. 7, so that they will project into the spaces between the anvils 14 of screen rolls 10B and 10C. A portion of each disc contains teeth 26, as shown in FIG. 8, which are beveled on each side as indicated at 28 to prevent them from becoming stuck between the anvils 14 when the disc 24 is in its lowermost position.

The discharge apparatus of direct reduction furnace 50 includes a seal leg assembly 52 which acts as a discharge pipe for hot metallized material from the direct reduction furnace. As shown in FIG. 1, reciprocable product pusher 54, which may be operated by a piston 55, beneath the discharge pipe 52 moves the hot reduced material product 56 off discharge plate 58 so that it falls downwardly onto the screen sizer apparatus. The undersize material passes through the gaps between the screen sizer rolls 10A, 10B, and 10C, and falls into bin 60. Oversize material, which is too resistant to sizing, is pushed through trampdoor 62 by the lifting action of the sizer roll 12, which then falls through chute 64 into bin 66.

Figure 2:
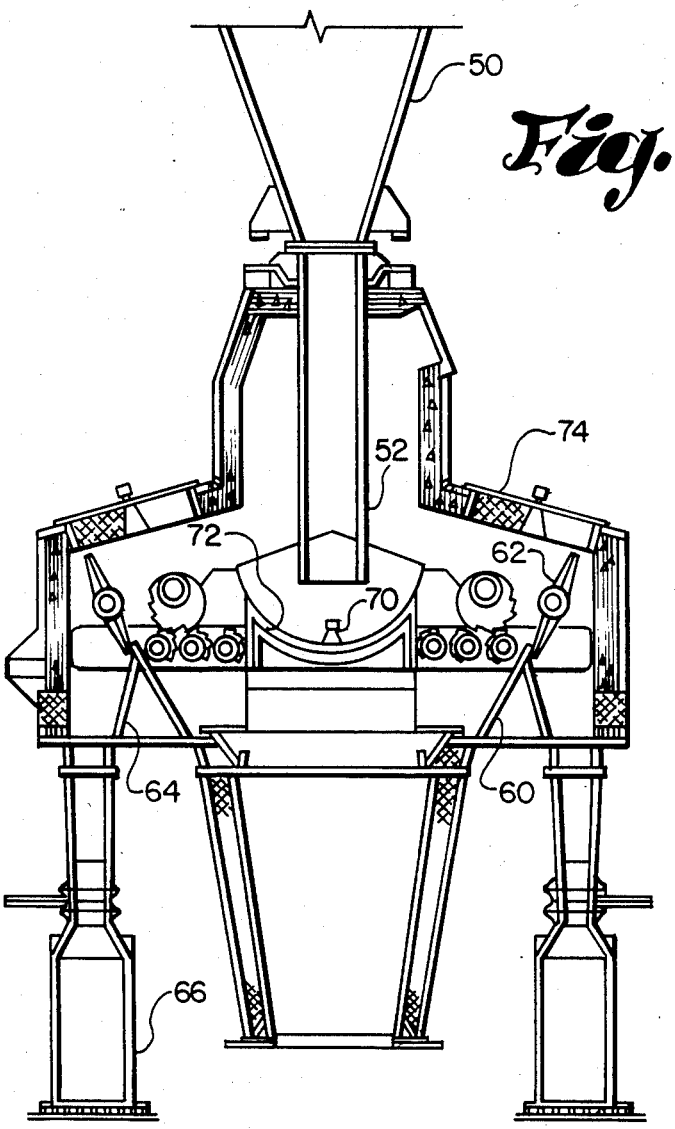
FIG. 2 is an elevational view of a vertical cross-section of the product discharge chamber of an alternative direct reduction furnace for the reduction of iron ore, showing the invented apparatus installed therein on each side of a product discharge wiper bar.

In the alternative embodiment of FIG. 2, a reciprocable wiper bar 70 beneath the discharge pipe 52 moves the hot reduced material product off wiper bar plate 72 so that it falls downwardly onto the screen sizer apparatus, onto first one roller table, then the other.

In order to prevent access by the elements, particularly air, rain, snow, and sleet, to the product during discharge, cover 74 surrounds the screen sizer apparatus and forms the product discharge chamber. Bin 60 beneath the screen sizer apparatus for accumulating sized material can have any desired size or configuration.

Gas within the product discharge chamber 74 of a direct reduction furnace is combustable, thus the chamber must be gas- tight.

Figure 5:
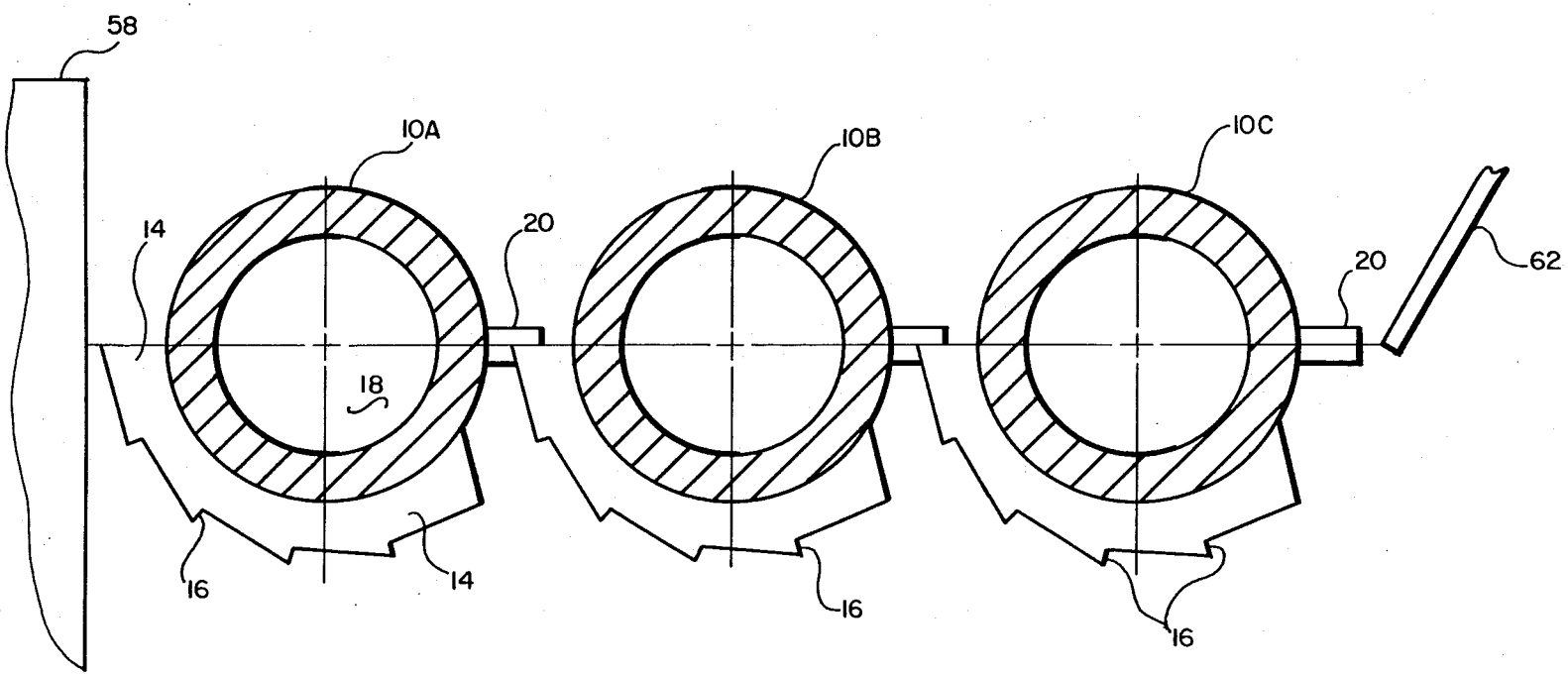
FIG. 5 is a sectional view of a roll table showing the lugs in the lowermost position.
Figure 6:
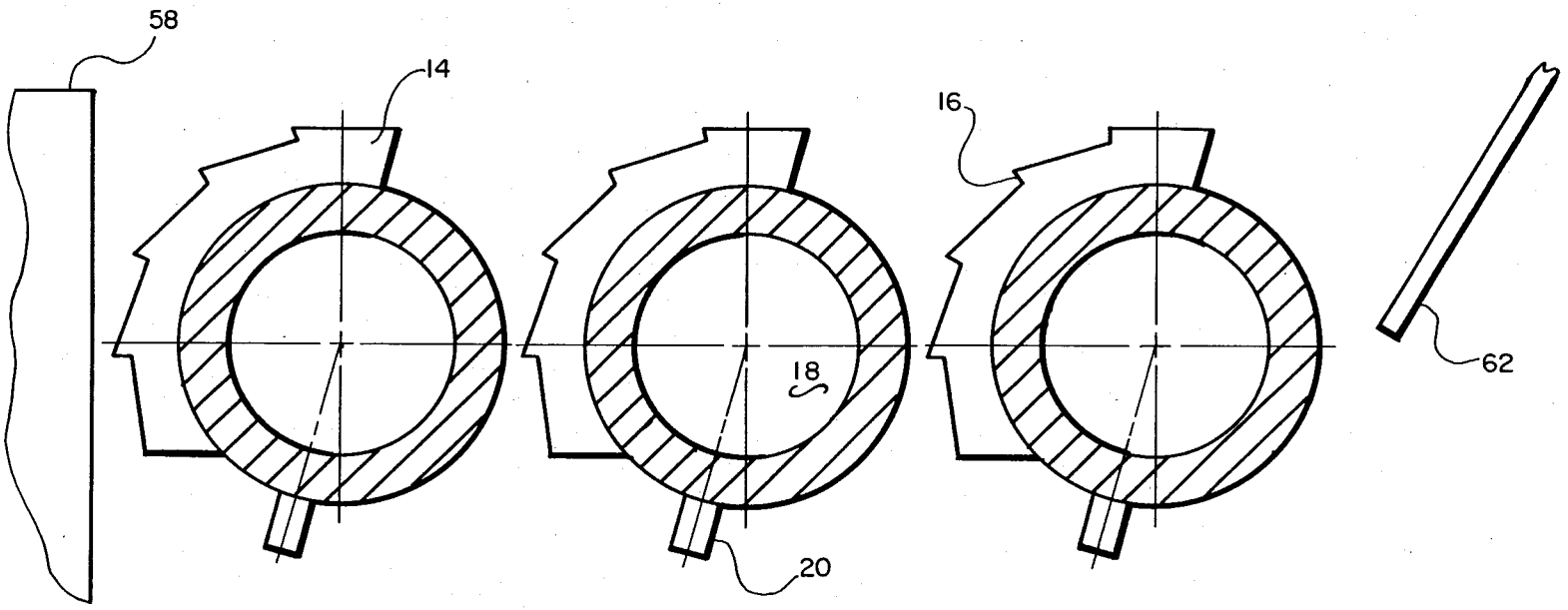
FIG. 6 is a sectional view of a roll table showing the lugs in the highest position.

In operation, lumps of materials to be sized, screened, or classified are dropped onto the first roll 10A with the anvils 14 in the initial position shown in FIG. 5. Undersized material will drop through the spaces between the anvils 14 and the rolls 10 into bin 60. Rotation of the screen rolls is commenced, and the anvils begin to move upwardly until they reach the top of the roll 10 as shown in FIG. 6. As can readily be seen from FIG. 3, almost any extremely large material will be broken as it is forced by the first set of anvils 14 on roll 10A against the back of the second set of anvils on roll 10B. Medium sized lumps will be broken by the reverse action of the anvils returning to the starting position, as the teeth 16 catch the lumps and break them against the roll. All undersized material will drop on through the openings between the rolls 10 and anvils 14, and all oversized material will progress to the next roll. Any material which has not been reduced to a sufficiently small size to pass through the openings between the rolls 10, anvils 14, and lugs 20, is conveyed into the path of rotating sizer roll 12 having a plurality of radially projecting discs 24 attached thereto in a helical pattern. The sizer roll 12, with its eccentrically mounted discs 24, turns continuously in the same direction so that the material being moved by the screen rolls can do so freely when the teeth of the sizer discs 24 are high, but when the screen rolls begin to return to their starting position, the teeth of the sizer roll discs start into their lower position and break any material between the teeth of the third screen roll. The sizer roll discs break additional lumps and clusters, then push the oversize material against pivotally mounted trampdoor 62, which opens against a spring, or alternatively a pneumatic cylinder. Any extremely oversize or hardened material is passed into the tramp discharge chute 64 by the action of the sizer roll 12 lifting in its bearings out of its normal operating position while continuing to rotate to push the tramp (undesirable) material through the trampdoor. Since it takes a positive action to open the trampdoor, any small material which had not dropped into the undersized bin 60 will do so when it hits the trampdoor.

Although the screen sizer apparatus will work without the sizer roll 12, the inclusion of the sizer roll in the apparatus will cause a substantial increase in the amount of material being reduced to the desired size.

While this invention has been described with respect to a facility for the direct reduction of iron, it is clear that it is equally applicable to any operation in which undesirable agglomerates or clusters are formed.

SUMMARY OF THE ACHIEVEMENTS OF THE OBJECTS OF THE INVENTION

It it readily apparent from the foregoing that we have provided a means for screening hot particulate materials subject to sticking or clustering during heat treatment, which will convey and separate clusters of material, break clusters to a predetermined size, separate oversized material, discharge sized material into one receptacle and discharge oversized material into a separate receptacle for further handling.

What is claimed is:

1. Apparatus for classifying and breaking clumps of material, comprising:

a plurality of rolls having parallel axes, mounted for simultaneous reciprocal rotation, each roll being rotatable at the same speed and in the same direction simultaneously;

each roll being provided with a plurality of equispaced breaker and carrier anvils extending from about 80° to about 120° about the circumference of the roll, each of said anvils being spaced from each adjacent anvil a distance equal to its own width.

2. Apparatus according to claim 1 further comprising a series of teeth on said anvils.

3. Apparatus according to claim 1 wherein the parallel axes of said rolls are coplanar.

4. Apparatus according to claim 3 wherein the plane of said parallel axes of said rolls is horizontal.

5. Apparatus according to claim 1 further comprising a feed mechanism for introducing material to be classified onto the first of said rolls, side shields at each end of said rolls for retaining material to be classified on said apparatus, and a receiving bin beneath said rolls for receiving classified material.

6. Apparatus according to claim 5 further comprising a discharge chute adjacent the end of the last of said rolls in the series for receiving oversized material.

7. Apparatus according to claim 5, further comprising a pivotally-mounted door atop said chute.

8. Apparatus according to claim 7 wherein said door has associated closure means urging said door into the closed position.

9. Apparatus according to claim 8 wherein said closure means is a spring.

10. Apparatus according to claim 8 wherein said closure means is a fluid-operated cylinder.

11. Apparatus according to claim 1 further comprising a sizer roll mounted between and above the last and next to last screen rolls, with the axis of the sizer roll parallel to and approximately midway between the axes of the shafts of said screen rolls.

12. Apparatus according to claim 11 further comprising eccentrically mounted, laterally spaced discs mounted on said sizer roll.

13. Apparatus according to claim 12 wherein said discs are in a generally helical orientation from one end of the sizer roll to the other.

14. Apparatus according to claim 12 further comprising a portion of each disc containing teeth.

15. Apparatus according to claim 14 wherein said teeth are beveled on each side to prevent them from becoming stuck between the anvils of the screen rolls when said disc is in its lowermost position.

16. Apparatus according to claim 12 wherein each disc is oriented on said sizer roll at a 90° angle from each adjacent disc.

17. Apparatus according to claim 1, further comprising a plurality of protruding lugs on at least one of said rolls, one of said lugs protruding from said roll opposite the leading edge of each anvil on said roll.

18. Apparatus according to claim 17, further comprising a protruding lug on each of said rolls opposite the leading edge of each anvil on each roll.

19. Apparatus according to claim 17 wherein each protruding lug is cylindrically shaped.

20. A method for classifying and breaking clumps of material on a horizontally oriented roller table, each roll thereof containing a plurality of radially extending anvils about a portion of said roll, said method comprising:

introducing lumps of materials to be classified onto said horizontally oriented roller table;

activating said rolls to reciprocate simultaneously through an arc of from 80 to 120 degrees, moving the anvils from an initial position with their leading edges substantially within the horizontal plane of the axes of the rolls in the roller table to a second position with their leading edges substantially at the highest elevation on the rolls, the anvils forcing large material back against the adjacent roll, breaking the material;

returning said rolls to their initial position, the reverse action of the anvils breaking additional lumps;

collecting undersized material which drops through the spaces between the anvils and the rolls; and discharging oversize material to a location beyond the final roll in the roller table.

* * * * *